US006351855B1

(12) United States Patent
Allen

(10) Patent No.: US 6,351,855 B1
(45) Date of Patent: Mar. 5, 2002

(54) BATHROOM ODOR WITHDRAWAL SYSTEM

(76) Inventor: Larry F. Allen, P.O. Box 1084, Rural Chickasha, OK (US) 73023

( * ) Notice: Subject to any disclaimer, the term of this patent is extended or adjusted under 35 U.S.C. 154(b) by 0 days.

(21) Appl. No.: 09/654,338

(22) Filed: Sep. 7, 2000

(51) Int. Cl.[7] ..... E03D 9/04

(52) U.S. Cl. ..... 4/213; 4/347; 4/348; 4/349; 4/352

(58) Field of Search ..... 4/213, 347, 348, 4/349, 352

(56) References Cited

U.S. PATENT DOCUMENTS

| | | | | | |
|---|---|---|---|---|---|
| 3,887,949 | A | | 6/1975 | Osmond | 4/217 |
| 4,031,574 | A | | 6/1977 | Werner | 4/213 |
| 4,166,298 | A | * | 9/1979 | Pearson | 4/213 |
| 4,318,192 | A | | 3/1982 | Williams | 4/213 |
| 4,583,250 | A | * | 4/1986 | Valarao | 4/213 |
| 4,993,083 | A | | 2/1991 | Lemieux | 4/213 |
| 4,993,949 | A | | 2/1991 | Hill | 433/141 |
| 5,125,119 | A | * | 6/1992 | Munoz | 4/213 |
| 5,161,262 | A | | 11/1992 | Quaintance, Sr. | 4/213 |
| 5,325,544 | A | | 7/1994 | Busch | 4/213 |
| 5,369,810 | A | | 12/1994 | Warren | 4/213 |
| 5,394,569 | A | * | 3/1995 | Poirier et al. | 4/213 |
| 5,590,423 | A | | 1/1997 | Boykin | 4/213 |
| 5,606,747 | A | | 3/1997 | Dupont | 4/213 |
| 5,718,005 | A | * | 2/1998 | Ng | 4/213 |
| 5,940,893 | A | * | 8/1999 | Shum | 4/213 |
| 6,052,837 | A | | 4/2000 | Norton | 4/217 |

* cited by examiner

*Primary Examiner*—Steven O. Douglas
*Assistant Examiner*—Khoa Huynh
(74) *Attorney, Agent, or Firm*—R. William Graham

(57) ABSTRACT

A commode deodorizing filtering device for use in a commode water tank having an overflow tube operably disposed therein and communicating with a toilet bowl, and having refill device with refill tube and float operably disposed in the water tank, the device includes a housing having a first generally longitudinally disposed chamber extending inwardly from a first open surface in a bottom portion of the housing and of a size and configuration to removably receive the overflow tube and terminating into an upper interior surface portion. A second generally longitudinally is disposed chamber communicating with the upper interior surface portion and terminating into a lower interior surface portion of the housing and a third generally longitudinally is disposed chamber communicating with the lower interior surface portion and terminates into a second open surface in an upper portion of the housing. A fan is operably disposed in the housing to cause sufficient air flow to be drawn through the chambers from the bowl, and an air deodorizer is disposed within at least one of the chambers in a manner to receive air flow exiting from the overflow tube where upon exiting deodorizes the air.

13 Claims, 2 Drawing Sheets

BATHROOM ODOR WITHDRAWAL SYSTEM

BACKGROUND

Field of invention is toilet-filtering devices used to clean or process air from the toilet bowl (004/209.R/213).

DESCRIPTION OF PRIOR ART

Referenced patents: U.S. Pat. Nos. 4,993,083, 3,887,949, 5,369,810, 6,052,837, 5,590,423.

There are numerous patents covering this field, however, they all have serious shortcomings concerning being easily installed, fitting toilets without alteration, expense, complexity and other considerations. For example, U.S. Pat. No. 5,606,747 Dupont 1997 is a good idea but in the real world, will fit into only a few toilets without alterations, among other shortcomings of its design. Another good idea is U.S. Pat. No. 5,325,544 Busch 1994, but in reality will fit only a few toilets without alteration, among other shortcomings of its design. Generally, people will not alter their existing appliances.

DETAILED DESCRIPTION OF THIS INVENTION

Figures 1, 2, 3:
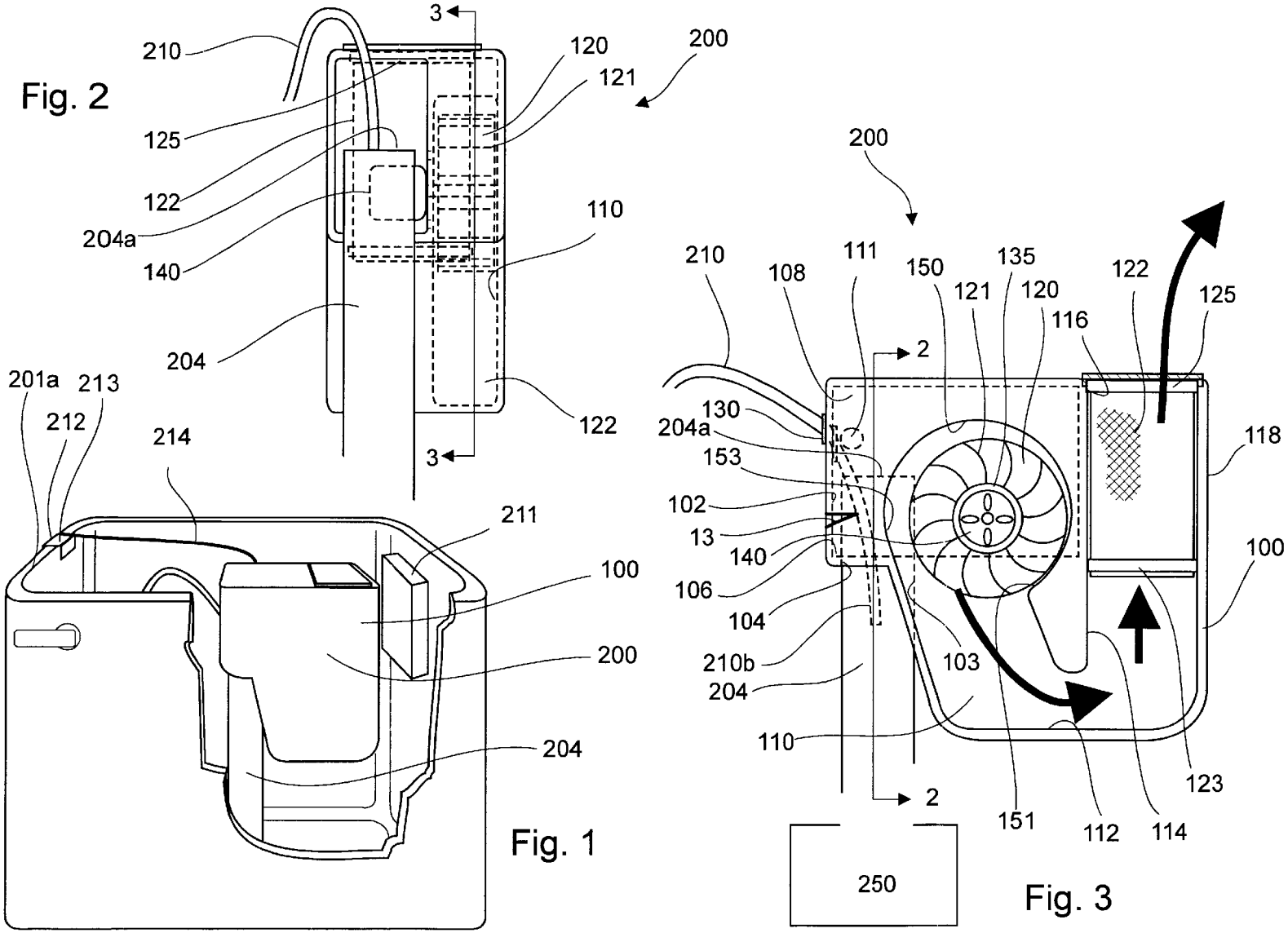
FIG. 1 shows the device in cross section form
FIG. 2 shows the rechargeable battery pack
FIG. 3 shows the device mounted in a water tank
Figure 4:
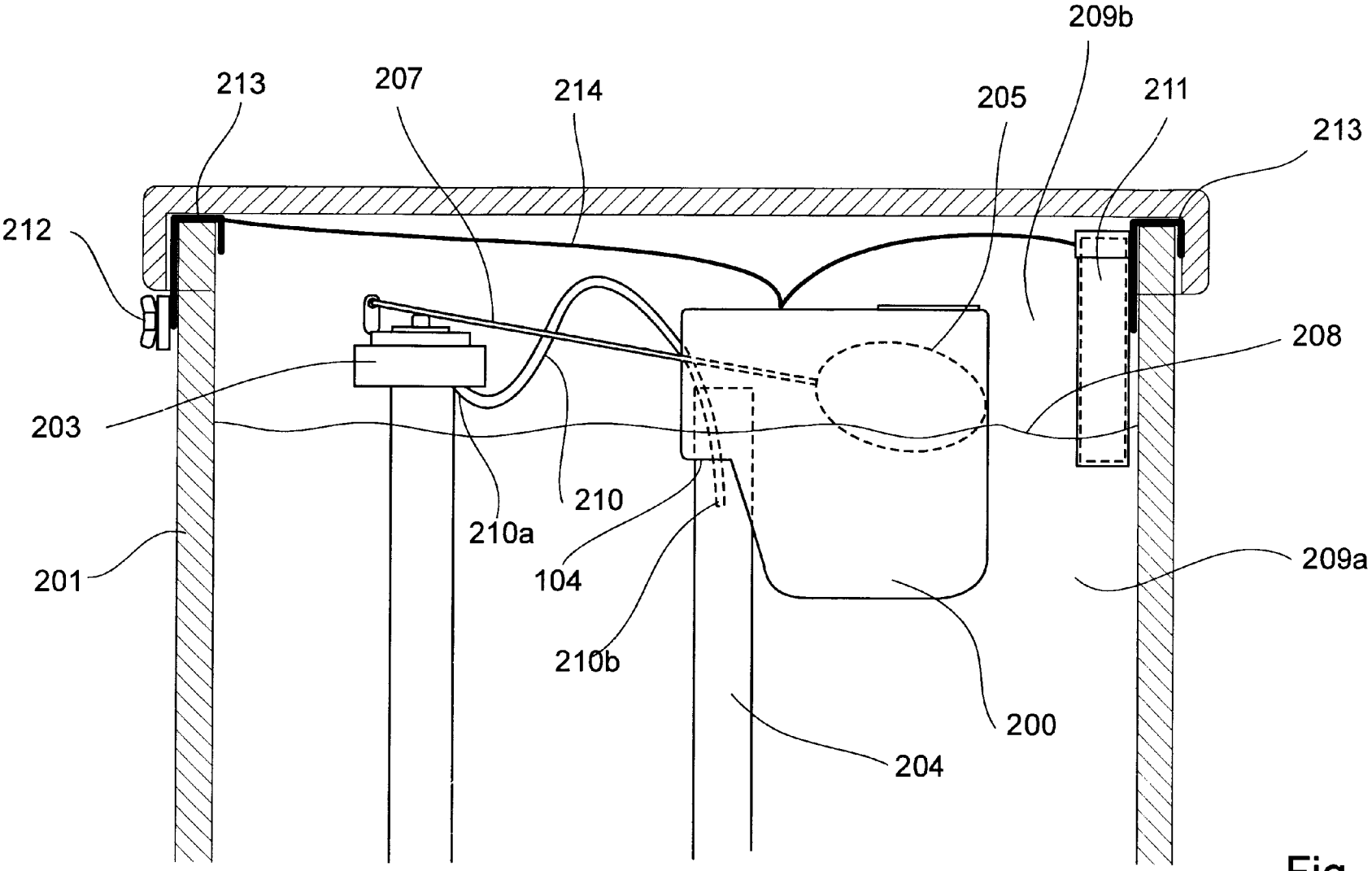
FIG. 4 shows the adaptor mounted on the device

Referring mainly to FIG. 3 showing this device mounted in a water tank:

This device 200 is slid down over (mounted) overflow tube 204 inside the commode water tank 209, extending down over the top of said tube 204A by the amount necessary to cause the air input cavity 200A, to go into the water, thus forming a low-pressure air seal with the water surface 208 allowing now-formed seal to be the connection of the device 200 to the bowl area 250 becoming the air passage system to deliver the fettered air into the inlet area 204A. The device 200 is controlled by pretty little bow switch 212, mounted onto top of water tank 201*a* at convenient location with clip 213 having 2-conductor wire 214 connecting it to the device 200. The space in said water tank 209A is limited, however the design of this device 200 and adaptor (FIG. 3A, 201–205) allows nominal operation of the float bulb 205, float rod 207, overflow tube 204 and filler valve 203 during flushing sequence. In conjunction with this device 200 mounted on overflow tube 203 is the filler tube 210 which delivers back fill water into the bowl area 250 from the sub-outlet tube connection 210A through tube 210 and out other end 210B during finish of flush cycle. As a person is using said commode, their body covers most of the area of the bowl opening allowing only a small amount of air to be extracted, consequentially preventing fettered air from escaping the bowl area before this invention extracts the fettered air.

Referring Now Mainly to FIG. 1

As explained in the previous paragraph, the connection was completed to the bowl area (FIG. 3, 250) thus begins the process of operation of this device in housing 1, held in place by support from overflow tube (FIG. 3, 204) in physical contact with compression fillet 13 applying force through the overflow tube (FIG. 3, 204), consequentially holding housing 1 in place through force to the opposite side (retainer wall 15A) also serving as a water dam having bottom portion 15 to keep water out of the housing 1, and to prohibit the unit to be pushed down too far onto the overflow tube (FIG. 3, 204) allowing water to enter the device unwontedly in area 12 is the stop 11, limiting said movement to an acceptable limit. As part of housing 1, the filler tube 24 is part of this invention being inserted into the overflow tube (FIG. 3,204), coming from the valve 16. As the fettered air device housing 1 through area 12, air cavity 19, air passage 18, moisture control agent area 21, around motor 3, through air inlet 14, due to a vacuum formed by fan 4, geometrically progressed-housing 9, fan air output passage 20, next forming the pressure side of the airflow dispelling fettered air next through area 17, air output threshold plate 10, then air passage 22, likewise air passage 23, continuing through cartridge screen 7A, separated herin by partition 8, seal "o" ring 7, activated charcoal 2 therein removing all odor, using seating surface 6, cartridge screen 5A, cartridge grille 5, passing into air space (FIG. 3, 209A), thus completing the process.

Explanation of FIG. 2

As shown in FIG. 2, the following is a description of the battery pack: The rechargeable battery 103 is deposited inside water-tight housing 102 having lid 100 and clip 101 which holds the housing (FIG. 3, 211) inside the water tank in a convenient location at the top of the water tank (FIG. 3,201A) delivering power through two-conductor electric wire 104 to device (FIG. 3A,200).

SUMMARY OF THIS INVENTION

This invention operates in conjunction with a toilet bowl, flush tank, with overflow tube therein. It has a vacuum air inlet (created by) a centrifugal fan/motor delivering next inside the device through an airflow chamber, through an activated charcoal cartridge, back into the bathroom air, more precisely drawing the fettered air from the toilet bowl through the water outlets therein, through the downlet passage of the bowl, through the bypass outlet of the flap valve, up through the overflow tube, through the low-pressure seal area of this device, hence into the afformentioned sequence. There are three critically balanced factors included in this device's design: physical configuration allowing it to fit in virtually all toilets without alteration, amount of charcoal-enough to filter the air totally and yet allowing enough cfm to pass to be effective, and the size, speed, configuration of the fan and housing to produce the correct amount of vaccum/pressure to be adequate without be offensive to the user of the toilet/device.

What is claimed is:

1. A commode filtering device for use in a commode water tank having an overflow tube operably disposed therein and communicating with a toilet bowl, and having refill device with a refill tube and float operably disposed in the water tank which includes:

a housing having a first generally longitudinally disposed chamber extending inwardly from a first open surface in a bottom portion of said housing and of a size and configuration to removably receive the overflow tube and terminating into an upper interior surface portion;

a second generally longitudinally disposed chamber communicating with said upper interior surface portion and terminating into a lower interior surface portion of said housing;

a third generally longitudinally disposed chamber communicating with said lower interior surface portion and terminates into a second open surface in an upper portion of said housing;

a fan including a rotatable hub and a plurality of fan blades radially extending therefrom and said fan is disposed in said second chamber, said fan operably disposed in said housing with said fan blades to rotate in a direction of air flow and in which to cause sufficient air flow to be drawn from said bowl through said first chamber and said second chamber and trapped from escaping back into said second chamber once entering said third chamber;

an air deodorizer disposed within said third chambers in a manner to extend from said second open surface into said third generally longitudinally disposed chamber to receive air flow exiting from the overflow tube where upon exiting deodorizes the air, and wherein said second chamber includes a partial arcuate surface portion of larger size than an area in which said fan operates and wherein said fan is disposed more closely to a starting point of said partial arcuate surface portion than an exiting end point of said partial arcuate surface portion such that upon operation of said fan creates less than atmospheric pressure in said second chamber substantially causing flow of air in the direction said fan blade rotation.

2. The commode filtering device of claim 1, wherein said deodorizer is a carbon filter.

3. The commode filtering device of claim 1, wherein said deodorizer is removably disposed in said third chamber.

4. The commode filtering device of claim 2, wherein said partial arcuate surface portion is partially cylindrical and said area is partially cylindrical.

5. The commode filtering device of claim 1, wherein said fan has a central axis of rotation which is generally normal to a direction of air flow through said chambers.

6. The commode filtering device of claim 1, wherein air flow from said upper interior surface portion enters said second chamber between said starting point and said exiting point.

7. The commode filtering device of claim 1, wherein said first chamber is characterized to receive the overflow tube in a manner to support said housing thereon.

8. The commode filtering device of claim 7, wherein said housing includes an inwardly extending position retaining member to permit the overflow tube to extend into said chamber to a predetermined distance in order to submerge said first open surface beneath water level in the water tank without permitting the water level to enter the upper interior portion.

9. The commode filtering device of claim 8, wherein a remaining internal portion of said housing is configured to prevent water from entry thereby lending buoyancy thereto and lessening load on the overflow tube.

10. The commode filtering device of claim 1, wherein said fan is powered by one of an ac and dc power source.

11. The commode filtering device of claim 10, wherein said power source is activated by a switch operably disposable on an outside portion of the toilet.

12. The commode filtering device of claim 1, wherein said housing has a refill tube receiving surface through said upper interior surface portion and said housing said housing permits the filler tube to be inserted into the overflow tube.

13. The commode filtering device of claim 12, wherein said housing includes a compression fillet for removably securing said filtering device to said overflow tube.

* * * * *